US008770466B1

(12) United States Patent
Terlesky et al.

(10) Patent No.: US 8,770,466 B1
(45) Date of Patent: Jul. 8, 2014

(54) DOUBLE PIZZA BOX

(76) Inventors: Robert J. Terlesky, Rogers, AR (US); Debra K. Mabry, Clinton Township, MI (US)

( * ) Notice: Subject to any disclaimer, the term of this patent is extended or adjusted under 35 U.S.C. 154(b) by 36 days.

(21) Appl. No.: 13/485,380

(22) Filed: May 31, 2012

Related U.S. Application Data

(60) Provisional application No. 61/536,722, filed on Sep. 20, 2011.

(51) Int. Cl.
*B65D 5/4805* (2006.01)
*B65D 25/04* (2006.01)

(52) U.S. Cl.
USPC ..... 229/120.13; 229/120; 229/120.21; 229/125; 229/906

(58) Field of Classification Search
USPC ..... 229/120, 120.13, 120.18, 120.21, 125, 229/902, 906; 206/45.29
See application file for complete search history.

(56) References Cited

U.S. PATENT DOCUMENTS

| | | | | |
|---|---|---|---|---|
| 1,411,678 | A * | 4/1922 | Walker | 229/125 |
| 1,731,414 | A | 10/1929 | Grossman | |
| 2,850,224 | A * | 9/1958 | Meinhardt et al. | 229/120.21 |
| 3,211,359 | A | 10/1965 | Fickes | |
| D261,990 | S | 11/1981 | Roccaforte | |
| 4,836,383 | A * | 6/1989 | Gordon et al. | 229/120.21 |
| D303,090 | S | 8/1989 | Armor et al. | |
| D306,697 | S | 3/1990 | Fonas | |
| 4,944,452 | A * | 7/1990 | Kent et al. | 229/120.21 |
| 4,957,237 | A * | 9/1990 | Madonna et al. | 229/120 |
| 5,351,880 | A * | 10/1994 | Goudreau | 229/178 |
| 5,445,314 | A * | 8/1995 | Newsome | 229/120.21 |
| D471,807 | S | 3/2003 | Sisinni | |
| D484,047 | S | 12/2003 | Hirschey | |
| 6,685,085 | B2 * | 2/2004 | Hanna | 229/152 |
| 6,752,311 | B2 | 6/2004 | Tulkoff | |
| 6,851,601 | B1 * | 2/2005 | Montoya | 229/120 |
| 6,915,949 | B1 * | 7/2005 | Economopoulos | 229/906 |
| D552,987 | S | 10/2007 | Magnusson | |
| D553,979 | S | 10/2007 | North | |
| D592,968 | S | 5/2009 | Lee et al. | |
| D649,040 | S | 11/2011 | Sanders | |
| D652,717 | S | 1/2012 | Shimoyama et al. | |
| 2004/0108370 | A1 * | 6/2004 | Lee | 229/120.13 |
| 2012/0111931 | A1 * | 5/2012 | Kimhi | 229/120 |

* cited by examiner

*Primary Examiner* — Gary Elkins
(74) *Attorney, Agent, or Firm* — QuickPatents; Kevin Prince

(57) ABSTRACT

The present invention comprises a corrugated box for separately holding two items, preferably cooked pizzas. The box comprises a base portion, a shelf portion, and a lid portion, with each portion having foldable walls. The first item will be enclosed between the base portion and the shelf portion, while the second item will be enclosed within the shelf portion and the lid. Score lines are used to indicate where folds should be made. Score lines are positioned where each of the above folds should be made, and can include perforation and cut lines. The shelf portion is removable.

17 Claims, 3 Drawing Sheets

DOUBLE PIZZA BOX

CROSS-REFERENCE TO RELATED APPLICATIONS

This application claims the benefit of U.S. Provisional Patent Application 61/536,722, filed on Sep. 20, 2011, and incorporated herein by reference.

STATEMENT REGARDING FEDERALLY SPONSORED RESEARCH AND DEVELOPMENT

Not Applicable.

FIELD OF THE INVENTION

This invention relates to corrugated boxes, and more particularly to a two-compartment pizza box.

DISCUSSION OF RELATED ART

Pizza has become an extremely popular food due to its great taste, low cost, and convenience. A pizzeria is an establishment which makes and sells pizzas, commonly through delivery. When delivering or otherwise transporting a cooked pizza, great care must be made to ensure the pizza is fresh, warm, and complete when it arrives at its destination.

Pizza boxes are commonly used to transport pizza from a pizzeria to the delivery location. A pizza box is typically made of corrugated cardboard due to its low cost and disposability, while still being stiff, absorbent and insulating. Typically, a pizza box will be manufactured and distributed as a flat, unfolded piece of corrugated cardboard. At the pizzeria, employees will fold the boxes for use.

Pizza boxes are traditionally plagued by several pitfalls. First, many pizza boxes will sag due to the heat and moisture of the pizza enclosed within. As such, it is common for the lid of a pizza box to sag and contact the pizza during transport. Furthermore, pizza boxes traditionally retain single pizzas, even when several are ordered. While using corrugated cardboard certainly reduces the environmental impact of a used pizza box, it can certainly be improved upon, especially when multiple pizzas are ordered by the same customer.

U.S. Pat. No. 5,950,912 to Economopoulos on Sep. 14, 1999, teaches a rectangular box for transporting two pizzas in a stacked formation formed by a single cardboard blank having scoring and cut-outs for assembling into a dual pizza box. The box has a bottom wall, four side walls, and a lid hinged to one of the side walls. When assembled, the box has corner shelf supports for positioning a second pizza. The shelf supports also provide a stop for the lid of the box to prevent crushing the contents. While this invention does disclose a pizza box capable of transporting multiple pizzas, it does so by including a separately attached shelf, and relies on corner shelf supports, increasing machine costs and complexity.

U.S. Pat. No. 6,752,311 to Tulkoff on Jun. 22, 2004, teaches a pizza box capable of transporting more than one pizza in a stacked formation. An upper level insert is provided for insertion into the pizza receiving compartment, the upper level insert being elevated above the bottom panel by at least one support flap. Again, while this invention does disclose a pizza box capable of transporting multiple pizzas, it is dependent on a separate insert for separating the pizzas, increasing costs and complexity.

Therefore, there is a need for a device that can transport more than one pizza in the same container, where all scoring and cutting is applied to a single blank, reducing costs and complexity. The present invention accomplishes these objectives.

SUMMARY OF THE INVENTION

The present device is capable of transporting more than one pizza in the same container, where all scoring and cutting is applied to a single blank, reducing costs and complexity. The present invention comprises a corrugated box for separately holding two items, preferably cooked pizzas. The box comprises a base portion, a shelf portion, and a lid portion, and can be defined as being in a flat blank configuration, or a fully folded configuration. The base portion comprises a bottom and four foldable side walls, with the left and right sides having flaps that are folded inward. The shelf portion comprises a center shelf with foldable sides that rest on the base portion, and is attached to the front wall of the base portion. The lid portion comprises a lid and foldable sides that rest adjacent to the base portion when closed, and is attached to the rear wall of the base portion.

When the box is laid flat in its unfolded, blank configuration, all walls are folded upward and the flaps are folded inward. The front wall of the base portion is then folded up and around the flaps such that the shelf portion is now positioned inside the walls of the base portion. Finally, the lid portion is folded around the flaps. The items are separately contained within the box when in this fully folded configuration.

Score lines are used to indicate where folds should be made. Score lines are positioned where each of the above folds should be made, and can include perforation. The score lines along the front wall may be double-score lines to accommodate the width of the flaps. Furthermore, cut portions and flexible connectors can be used between the front wall and the shelf portion so that the shelf portion can be removed.

Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 1:
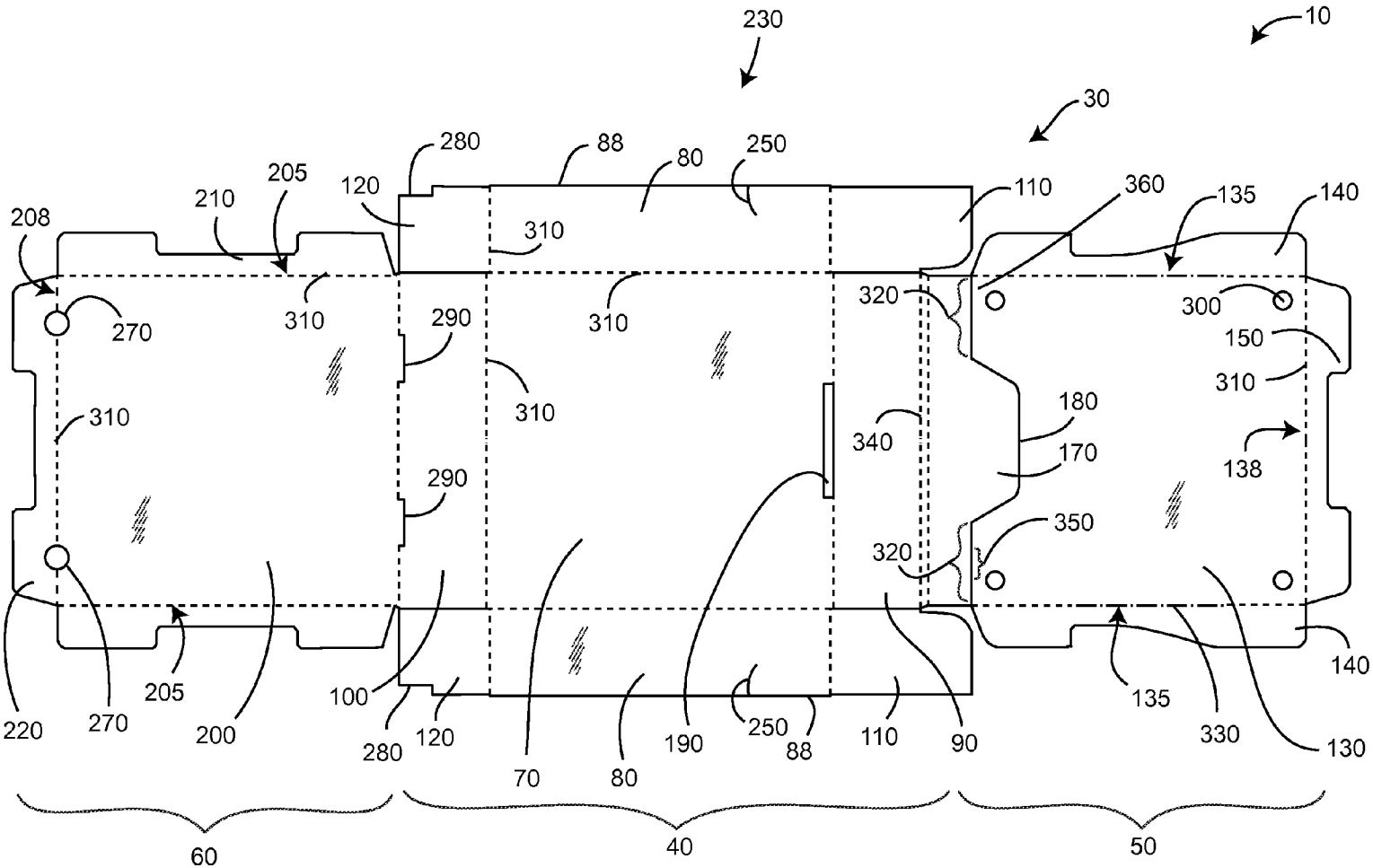
FIG. 1 is a top plan view of the double pizza box in a flat blank configuration.
Figure 2:
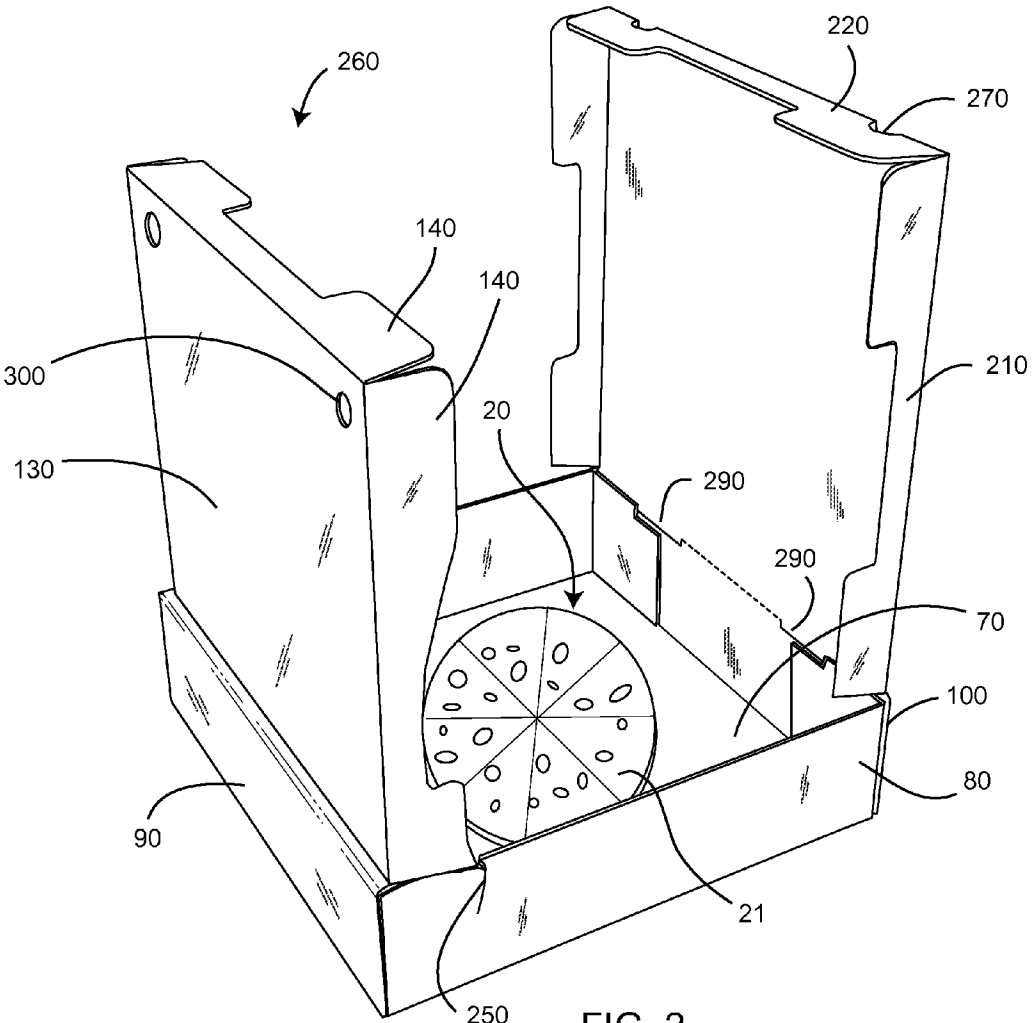
FIG. 2 is a perspective view of the double pizza box with the shelf and lid portions positioned vertically.
Figure 3:
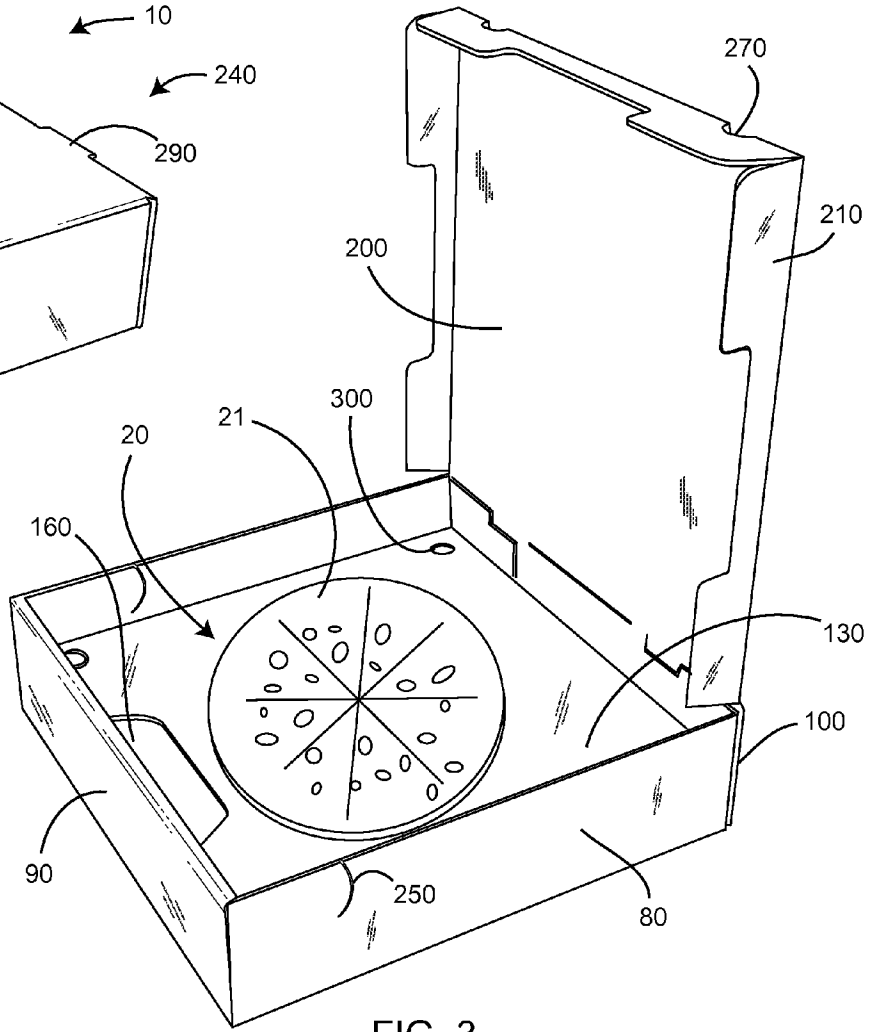
FIG. 3 is a perspective view of the double pizza box with the shelf portion positioned horizontally and the lid portion positioned vertically.
Figure 4:
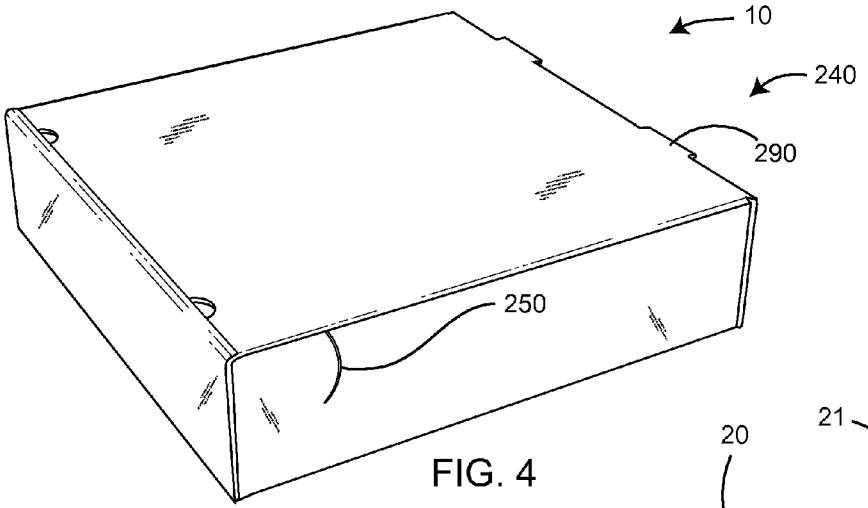
FIG. 4 is a perspective view of the double pizza box in a fully folded configuration.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list.

The present invention comprises a corrugated box 10 for separately holding two items 20, preferably cooked pizzas. The box 10 comprises a base portion 40, a shelf portion 50, and a lid portion 60, and can be defined as being in a flat blank configuration 230, or a fully folded configuration 240. The base portion 40 comprises a box bottom 70, two foldable opposing side walls 80, and a foldable front wall 90 opposed to a foldable rear wall 100. Each side wall 80 terminates at a forward side wall flap 110 and a rearward side wall flap 120. The items 20 are separately contained within the box 10 when in this fully folded configuration 240.

The shelf portion 50 comprises a center shelf 130 foldably fixed with the front wall 90 opposite the box bottom 70. The shelf portion 50 further includes two foldable center shelf support flaps 140 at opposing side edges 135 thereof and one foldable center shelf support flap 150 at a forward side 138 thereof. The center shelf 130 further includes a vent 160 and a center locking tab 170 mutually formed at a single cut line 180 therebetween. The center locking tab 170 is adapted to fit within a tab locking slot 190 on the box bottom 70 adjacent to the front wall 90. In an alternative embodiment, the center shelf 130 further includes at least one center shelf finger aperture 300.

The lid portion 60 comprises a top lid 200 foldably fixed with the rear wall 100 opposite the box bottom 70. The lid portion 60 further includes two foldable side lid flaps 210 at opposing side edges 205 thereof, and a foldable front lid flap 220 at a forward side 208 thereof opposite the box bottom 70. In an alternative embodiment, the top lid 200 includes at least one rear vent 290 formed between the rear wall 100 and the top lid 200. In a further alternative embodiment, the top lid 200 includes two rear vents 290 and each rearward side wall flap 120 is notched 280 so as to not occlude one of the rear vents 270 when the box 10 is in the fully folded configuration 240. In yet a further alternative embodiment, the top lid 200 further includes at least one top lid vent 270 formed therethrough.

When the box 10 is laid flat in its unfolded, blank configuration 230, the forward and rearward side wall flaps 110, 120 are folded upward, followed by folding each side wall 80 upward, causing the side wall flaps 110, 120 to face inward. The front wall 90 is then folded up and around the forward side wall flaps 110 such that the center locking tab 170 engages the tab locking slot 190 of the box bottom 70. Separating the center locking tab 170 from the center shelf 130 also opens a space for the vent 160 in the center shelf 130. The first of the items 21 will be placed on the box bottom 70 and enclosed within the box bottom 70, walls 80, 90, 100, and center shelf 130.

In order to support a second item 22, the center shelf 130 must be folded next. The center shelf 130 is attached to the front wall 90, and as such, has been folded over the side wall flaps 110, 120 such that it is facing downward towards the box bottom 70. Each center shelf support flap 140, 150 is folded down and positioned inside of and adjacent to the side and rear walls 80, 100 to support the center shelf 130 and second item 22 on the box bottom 70. In an alternative embodiment, each side wall 80 includes a curved locking cut 250 at a top edge 88 thereof, whereby the center shelf support flaps 150 may be engaged therewith to retain the center shelf 130 in a raised position while the first item 21 is placed onto the box bottom 70.

The lid portion 60 must be folded next to enclose the items 20 within the box 10. First, the side and front lid flaps 210, 220 are folded upward. Then, the top lid 200 and rear wall 100 are folded upward to allow the top lid 200 to be folded around the rearward side wall flaps 120 such that the side and front lid flaps 210, 220 are positioned inside of and adjacent to the side and rear walls 80, 100 and are supported by the center shelf 130. In an alternative embodiment, all side wall flaps 110, 120, support flaps 140, 150, and lid flaps 210, 220 are folded upward first when in the unfolded, blank configuration 230, with the front wall 90 then folded over the front wall flaps 110 and the rear wall 100 then folded over the rear wall flaps 120, resulting in the fully folded configuration 240.

Score lines 310 are used to indicate where folds should be made. Score lines 310 are included between the box bottom 70 and the side, front, and rear walls 80, 90, 100, and between the side walls 80 and the forward and rearward flaps 110, 120. Score lines 310 are also included between the front wall 90 and the center shelf 130, between the center shelf 130 and the center shelf support flaps 140, between the top lid 200 and the rear wall 100, and between the top lid 200 and the side and front lid flaps 210, 220. In an alternative embodiment, the score lines 310 at the side edges 135 of the center shelf 130 are further perforated 330. In a further alternative embodiment, the score line 310 between the front wall 90 and the center shelf 130 is a double score line 340 for accommodating a thickness of the forward side wall flaps 110.

The score lines 310 are further included as opposing extensions 320 of the single cut line 180 of the center shelf 130 towards each opposing side edge 135 thereof. In an alternative embodiment, the extensions 320 each include cut portions 350 and flexible connectors 360, whereby the center shelf 130 is fastened to the center locking tab 170 tenuously by the connectors 360 which, if pressed against, will break to set free the center shelf 130 from the front wall 90.

While a particular form of the invention has been illustrated and described, it will be apparent that various modifications can be made without departing from the spirit and scope of the invention. For example, while a corrugated material is used in the preferred embodiment, any suitable material can be used. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A box for separately holding two items, the box made of a foldable corrugated blank comprising:

a base portion comprising a box bottom, two foldable opposing side walls, a foldable front wall opposed to a foldable rear wall, each side wall terminating at a forward side wall flap and a rearward side wall flap, each side wall including a curved locking cut at a top edge thereof;

a shelf portion comprising a center shelf foldably fixed with the front wall opposite the box bottom and including two foldable center shelf support flaps at opposing side edges thereof and one foldable center shelf support flap at a forward side thereof, the center shelf further including a vent and a center locking tab mutually formed at a single cut line, the box bottom including a tab locking slot adjacent the front wall; and a lid portion comprising a top lid foldably fixed with the rear wall opposite the box bottom and including two foldable side lid flaps at opposing side edges thereof and a foldable front lid flap at a forward side thereof opposite the box bottom;

whereby with the box in a flat blank configuration, the forward and rearward side wall flaps may be folded upward and each side wall then folded upward, the front wall may then be folded up and around the forward side wall flaps such that the center locking tab engages the tab locking slot of the box bottom, allowing a first of the items to be placed on the box bottom and opening the vent in the center shelf, each center shelf support flap then folded down to support the center shelf on the box bottom as the center shelf is folded down towards the box bottom, whereupon a second of the items may be placed on the center shelf, the side and front lid flaps then being folded upward to allow the top lid to be folded around the rearward side wall flaps to be supported by the center shelf, whereby the items are separately contained within the box, the box being in a fully folded configuration, and whereby the center shelf support flaps at opposing side edges of the center shelf may be engaged with the curved locking cuts to retain the center shelf in a raised position while the first item is placed onto the box bottom.

2. The box of claim 1 wherein the top lid further comprises at least one top lid vent formed therethrough.

3. The box of claim 1 wherein the center shelf further comprises at least one center shelf finger aperture.

4. The box of claim 1 wherein score lines are included between the box bottom and the side, front and rear walls, between the side walls and the forward and rearward flaps, between the front wall and the center shelf, between the center shelf and the center shelf support flaps, between the top lid and the rear wall, between the top lid and the side and front lid flaps, and as opposing extensions of the single cut line of the center shelf towards each opposing side edge thereof.

5. The box of claim 4 wherein the score lines at the side edges of the center shelf are further perforated.

6. The box of claim 4 wherein the score line between the front wall and the center shelf is a double score line for accommodating a thickness of the forward side wall flaps.

7. The box of claim 4 wherein the extensions each include cut portions and flexible connectors, whereby the center shelf is fastened to the center locking tab tenuously by the connectors which, if pressed against, will break to set free the center shelf from the front wall.

8. A box for separately holding two items, the box made of a foldable corrugated blank comprising:

a base portion comprising a box bottom, two foldable opposing side walls, a foldable front wall opposed to a foldable rear wall, each side wall terminating at a forward side wall flap and a rearward side wall flap;

a shelf portion comprising a center shelf foldably fixed with the front wall opposite the box bottom and including two foldable center shelf support flaps at opposing side edges thereof and one foldable center shelf support flap at a forward side thereof, the center shelf further including a vent and a center locking tab mutually formed at a single cut line, the box bottom including a tab locking slot adjacent the front wall; and a lid portion comprising a top lid foldably fixed with the rear wall opposite the box bottom and including two foldable side lid flaps at opposing side edges thereof and a foldable front lid flap at a forward side thereof opposite the box bottom;

whereby with the box in a flat blank configuration, the forward and rearward side wall flaps may be folded upward and each side wall then folded upward, the front wall may then be folded up and around the forward side wall flaps such that the center locking tab engages the tab locking slot of the box bottom, allowing a first of the items to be placed on the box bottom and opening the vent in the center shelf, each center shelf support flap then folded down to support the center shelf on the box bottom as the center shelf is folded down towards the box bottom, whereupon a second of the items may be placed on the center shelf, the side and front lid flaps then being folded upward to allow the top lid to be folded around the rearward side wall flaps to be supported by the center shelf, whereby the items are separately contained within the box, the box being in a fully folded configuration, wherein the top lid includes two rear vents formed between the rear wall and the top lid and wherein each rearward side wall flap is notched so as to not occlude one of the rear vents when the box is in the fully folded configuration.

9. A box for separately holding two items, comprising:

a foldable corrugated blank that includes a base portion, a shelf portion, and a lid portion;

the base portion comprising a box bottom, two foldable opposing side walls, a foldable front wall opposed to a foldable rear wall, each side wall terminating at a forward side wall flap and a rearward side wall flap, each side wall including a curved locking cut at a top edge thereof;

the shelf portion comprising a center shelf foldably fixed with the front wall opposite the box bottom and including two foldable center shelf support flaps at opposing side edges thereof and one foldable center shelf support flap at a forward side thereof, the center shelf further including a vent and a center locking tab mutually formed at a single cut line, the box bottom including a tab locking slot adjacent the front wall; and the lid portion comprising a top lid foldably fixed with the rear wall opposite the box bottom and including two foldable side lid flaps at opposing side edges thereof and a foldable front lid flap at a forward side thereof opposite the box bottom;

whereby with the box in a flat blank configuration, the forward and rearward side wall flaps may be folded upward and each side flap then folded upward, the front wall may then be folded up and around the forward side wall flaps such that the center locking tab engages the tab locking slot of the box bottom, allowing a first of the items to be placed on the box bottom and opening the vent in the center shelf, each center shelf support flap then folded down to support the center shelf on the box bottom as the center shelf is folded down towards the box bottom, whereupon a second of the items may be placed on the center shelf, the side and front lid flaps then being folded upward to allow the top lid to be folded around the rearward side wall flaps to be supported by the center shelf, whereby the items are separately contained within the box, the box being in a fully folded configuration, and whereby the center shelf support flaps at opposing side edges of the center shelf may be engaged with the curved locking cuts to retain the center shelf in a raised position while the first item is placed onto the box bottom.

10. The box of claim 9 wherein the top lid includes at least one rear vent cut between the rear wall and the top lid.

11. The box of claim 10 wherein the top lid includes two of the rear vents and wherein each rearward side wall flap is notched so as to not occlude one of the rear vents when the box is in the fully folded configuration.

12. The box of claim 9 wherein the top lid further includes at least one top lid vent formed therethrough.

13. The box of claim 9 wherein the center shelf further includes at least one center shelf finger aperture.

14. The box of claim 9 wherein score lines are included between the box bottom and the side, front and rear walls, between the side walls and the forward and rearward flaps, between the front wall and the center shelf, between the center shelf and the center shelf support flaps, between the top lid and the rear wall, between the top lid and the side and front lid flaps, and as opposing extensions of the single cut line of the center shelf towards each opposing side edge thereof.

15. The box of claim 14 wherein the score lines at the side edges of the center shelf are perforated.

16. The box of claim 14 wherein the score line between the front wall and the center shelf is a double score line for accommodating a thickness of the forward side wall flaps.

17. The box of claim 14 wherein the extensions each include cut portions and flexible connectors, whereby the center shelf is fastened to the center locking tab tenuously by the connectors which, if pressed against, will break to set free the center shelf from the front wall.

* * * * *